US005135130A

United States Patent [19]

Andrews

[11] Patent Number: 5,135,130

[45] Date of Patent: Aug. 4, 1992

[54] SAFETY ENCLOSURE

[76] Inventor: James S. Andrews, 11867 Crescent Park Dr., Golden, Colo. 80403

[21] Appl. No.: 669,114

[22] Filed: Mar. 13, 1991

[51] Int. Cl.[5] ..... B65D 45/00

[52] U.S. Cl. ..... 220/260; 220/327; 220/328; 86/50

[58] Field of Search ..... 220/260, 262, 315, 327, 220/328; 86/50

[56] References Cited

U.S. PATENT DOCUMENTS

| | | | |
|---|---|---|---|
| 1,086,708 | 2/1914 | Hoagland | 86/50 |
| 1,477,404 | 12/1923 | Watson | 220/908 X |
| 1,695,133 | 12/1928 | Allen | 220/908 X |
| 2,917,927 | 12/1959 | Clark | 86/50 X |
| 3,064,931 | 11/1962 | Rowe | 220/262 X |
| 3,165,916 | 1/1965 | Loving, Jr. | 86/50 X |
| 3,721,201 | 3/1973 | Boller | 86/50 X |
| 3,772,958 | 11/1973 | Mullarkey | 86/50 X |
| 3,981,409 | 9/1976 | Flanders | 220/324 X |
| 4,325,309 | 4/1982 | King et al. | 86/50 X |
| 4,411,372 | 10/1983 | Basterfield et al. | 220/327 |
| 4,487,266 | 12/1984 | Gillis et al. | 169/51 |
| 4,615,454 | 10/1986 | Verhoog, Jr. | 220/908 X |
| 4,895,271 | 1/1990 | Desjardins et al. | 220/335 |

*Primary Examiner*—Stephen Marcus
*Assistant Examiner*—Nova Stucker
*Attorney, Agent, or Firm*—Kenneth Johnston, II

[57] ABSTRACT

A safety enclosure providing quick and easy access to the processing area comprising a counter-weighted movable open ended cylinder capable of being raised and lowered and in this lowered position can be securely affixed by swing away clamps to a flanged pressure vessel head containing processing equipment for pyrotechnic materials whereby detonation of materials in the enclosure during processing contains and directs the blast upward through the blast venting protecting the workers and equipment external to said safety enclosure.

2 Claims, 2 Drawing Sheets

19
36
34
35
37
27
20
32
28
48
50
22
24

20
48
42
40

42
20

48
40
46
44
20
19
50
50
10
28
28
46
40
44
48
22

SAFETY ENCLOSURE

BACKGROUND OF THE INVENTION

This invention relates generally to a safer, easily accessible, safety enclosure, more particularly to an apparatus for containment and directing inadvertent spontaneous ignition or explosion of pyrotechnic materials during processing such as automobile air bag inflators.

Currently the industry utilizes square or rectangular safety enclosures which have extremely limited access to the production equipment within. Because of the potential reduction in strength that access ports impart, generally very small access ports are provided most of which do not allow much more than an arm into the safety enclosure. Further because of the rectangular shape of the devices in use, they are generally made of substantially heavier material to withstand any potential explosion. Although the devices are built to withstand substantial pressure from an explosion and to contain and direct the blast upward and away from workers and other equipment, its necessary to be able to work on the processing equipment without the requirements of disassembling part of the safety enclosure to do so, which is the case for the current safety enclosures. Users, generally, of pyrotechnic materials limit the amount of materials in the safety enclosure at any one time and this should also be done in keeping with current practices even with the within device. As with any type of hazardous material, the safety limits can be exceeded.

The object of this invention, therefore, is to provide an improved safety enclosure which would still contain and direct upwardly the blast from any spontaneous ignition of a pyrotechnic material being processed within and still having an ease of accessibility to work in the processing equipment when the pyrotechnic material has been removed.

There are various explosion suppressing or containment devices, such as, Hoaglend U.S. Pat. No. 1,086,708, Clark U.S. Pat. No. 2,917,927, Loving U.S. Pat. No. 3,165,916, Boller U.S. Pat. No. 3,721,201, Mullarkey U.S. Pat. No. 3,772,958, Gillis U.S. Pat. No. 4,487,266, and King et al U.S. Pat. No. 4,325,309, all of which are limited either as being extremely bulky, cumbersome, complex, or simply do not provide the protection to individual workers and surrounding equipment and yet allows easy accessibility to production equipment within the apparatus. In fact the cited devices are generally designed for multiple explosive detonations or are so cumbersome that they do not lend themselves to a production line.

SUMMARY OF THE INVENTION

Briefly, the present invention provides for the encasement of a potentially explodable material such as a pyrotechnic in a production environment and yet allows for ease of access to the equipment when repairs or other related activities are required.

It comprises of a counter weight biased toward raising an open ended cylinder, hereinafter referred to as an access door, which is roller guided and is raised exposing the entire processing area and closed allowing the processing of the pyrotechnic materials safely. In the closed position the access door is secured by swing clamps which clamp flanges on the access door and on the pressure vessel head and prevent an inadvertent opening. The device channels any explosion upward through a stack and blast gate which is generally attached to such devices.

By raising the access door, access to the processing area is almost 360° and is limited only by the support frame which extends up the sides of the safety enclosure.

BRIEF DESCRIPTION OF THE DRAWINGS

These and other aspects of the invention will be more fully understood by referring to the detailed description and accompanying drawings in which.

DESCRIPTION OF THE PREFERRED EMBODIMENT

Figure 1:
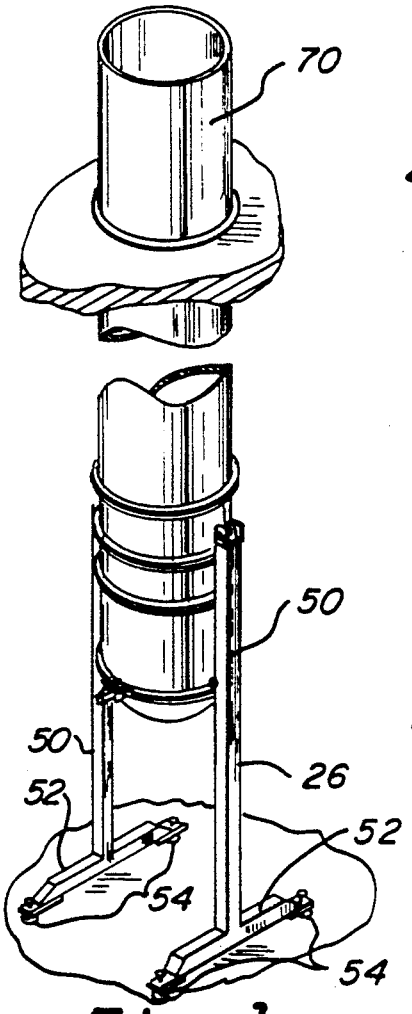
FIG. 1 is a schematic perspective view of the safety enclosure.
Figure 2:
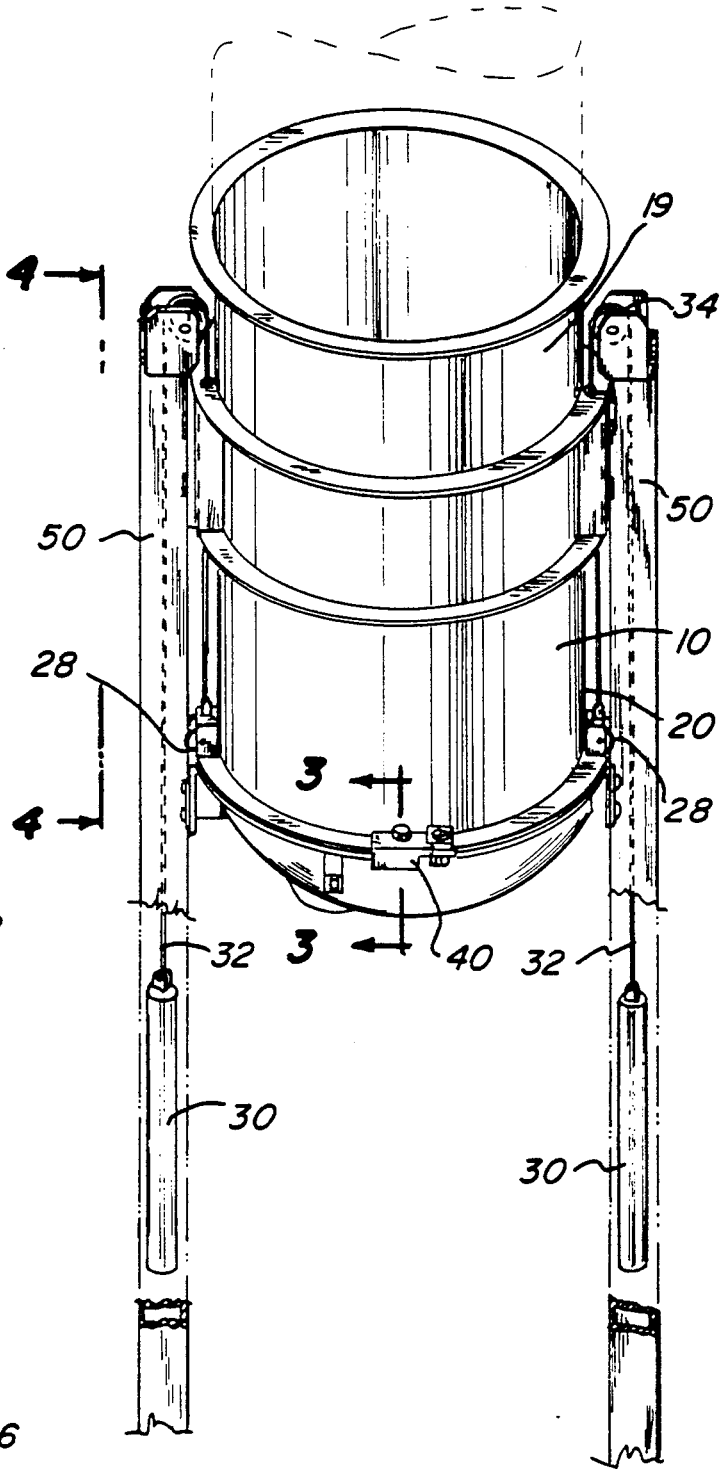
FIG. 2 is a perspective view of the safety enclosure.
Figures 4, 5, 6, 7:
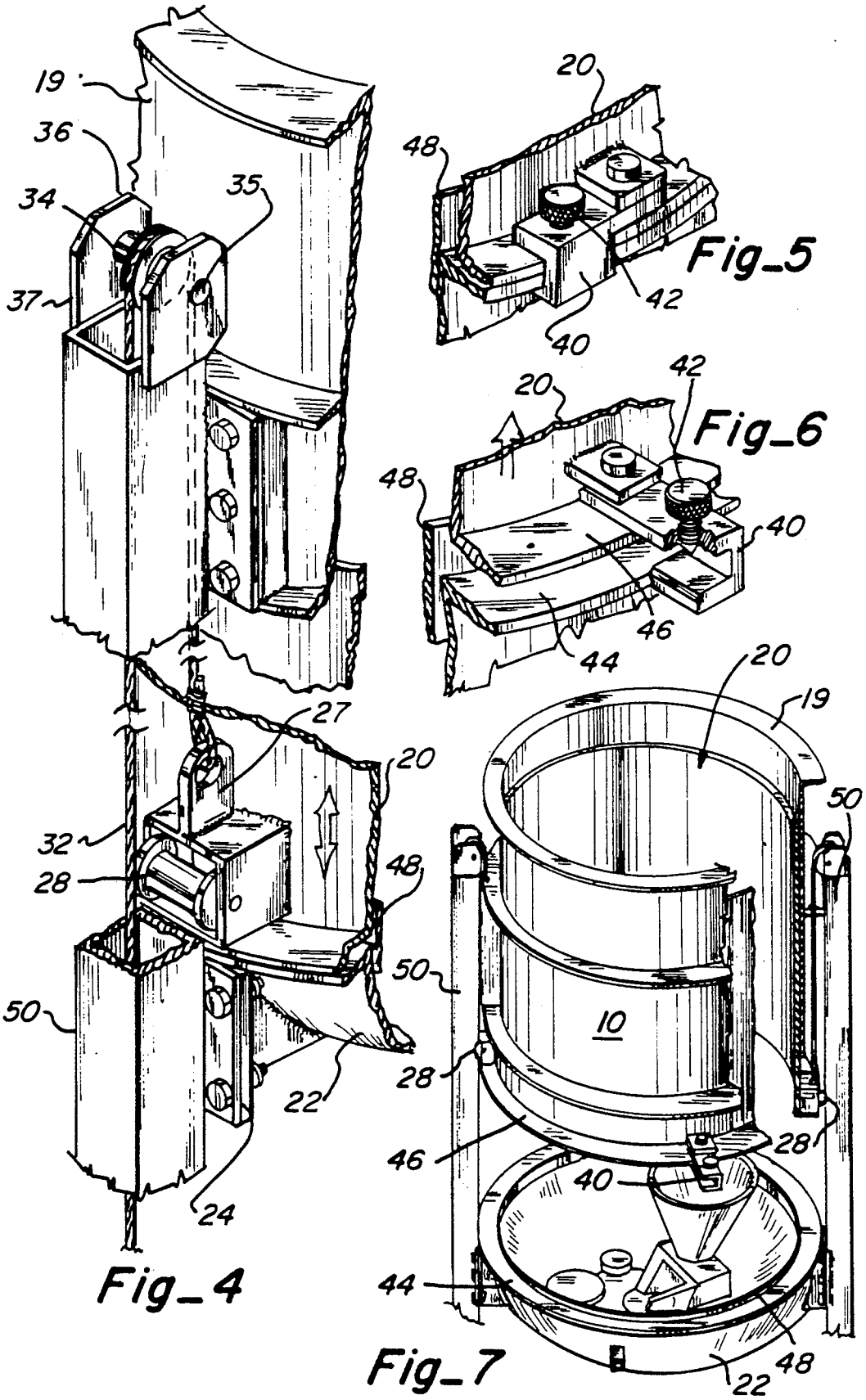
FIG. 4 is a cross-section of the support frame and closure taken along the line 4—4 of FIG. 2.
FIG. 5 is a side perspective view of the swing clamp of invention in the locked position.
FIG. 6 is a side perspective view of the swing clamp of the invention in the unlocked position.
FIG. 7 is a schematic perspective of the safety enclosure with the access door open.

Illustrated in FIGS. 1, 2, and 7 is the safety enclosure 10 for directing inadvertent explosions upward and away from the operator. The safety enclosure 10 includes a frame 26 having two vertical supports 50 each centered over a horizontal base support 52 with adjustable feet 54 capable of leveling the safety enclosure 10. Pressure vessel head 22 is in the secured position as shown in FIGS. 1, 2, and 4. Access door 20 and pressure vessel head 22 are secured in position by means of a plurality of swing clamps 40 as shown in FIGS. 1, 2, and 4. Swing clamps 40 are swingably affixed to flange 46 allowing swing clamps 40 to be in the closed and open positions as shown in FIGS. 5 and 6 respectively.

Figure 3:
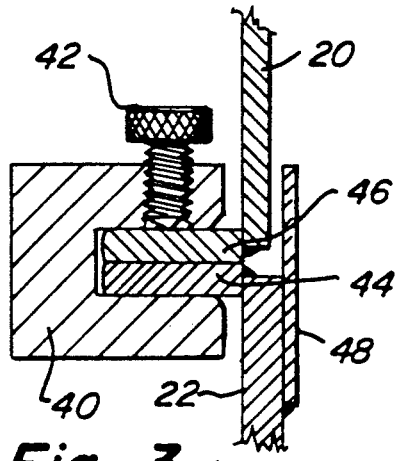
FIG. 3 is a cross-sectional view of the swing lock and blast shield taken along the lines 3—3 of FIG. 2.

When swing clamps 40 are in the open position access door 20 may be raised as within the superstructure 19 shown in FIG. 7 allowing work to be done on the equipment located within the safety enclosure 10. Pressure vessel head 22 has a blast shield 48 affixed in a manner that when the access door 20 is in the down and closed position that blast shield 48 extends above flange 46 so that in the event of an inadvertent ignition or explosion, the blast is directed upward past the closure point made between flanges 46 and 44 as shown in FIG. 3 and up through the superstructure 19 which is vented to the outside by way of vent 70 as shown in FIG. 1.

In the closed position swing clamps 40 are locked in place by thumb screw 42 prohibiting an inadvertent opening of the safety enclosure 10.

When the equipment within the safety enclosure 10 has need of maintenance, thumb screw 42 are unscrewed allowing swing clamps 40 to swing open. Access door 20 is then moved upward by the counter weights 30 moving downward which are slightly heavier than access door 20. Counter weights 30 are suspended at one end of cable 32 inside vertical supports 50 and cable 32 is affixed to access door 20 at the opposite end of cable 32 at cable bracket 27. Cable 32 rides on pulley 34 for ease of raising and lowering access door 20. Pressure vessel head 22 is affixed to vertical supports 50 by brackets 24. Pulley 34 is off set in pulley assembly 37 which is held in place by pin 35 and affixed to vertical support 50 by pulley assembly frame 36. The offset of pulley 34 allows the access door 20 to be raised and lowered within the superstructure 19 without binding and the counter weights 30 to move freely within the vertical support 50.

When access door 20 is raised or lowered within the superstructure 19 guide roller 28 rides up and down the vertical supports 50 allowing access door 20 and pressure vessel head 22 to remain in alignment after each raising and lowering of the access door 20.

Because the counter weights 30 are slightly heavier than access door 20 accidental closure on an individual working on equipment installed in the pressure vessel head 22 is eliminated.

Obviously, many modifications and variations of the present invention are possible in light of the above teachings such as fixing the access door 20 and making the pressure vessel head 22 movable.

Although the present invention has described its use with pyrotechnic materials, the device may be utilized for other hazardous materials or processes.

Although a preferred embodiment of the invention has been described in detail such description is intended to be illustrative only, and not restrictive, since many details of the construction of the invention may be altered or modified without departing from the spirit or scope thereof.

What is claimed:

1. A safety enclosure which provides 360° access to equipment within comprising:

a frame means having a pressure vessel means affixed thereto capable of having pyrotechnic processing equipment therein;

a access door means capable of having a raised position and a lowered position whereby when said access door means is in said lowered position, said access door means is in communication with said pressure vessel head means;

a superstructure means comprising a concentric cylindrical mating extension that said access door means moves upwardly and downwardly within and when said access door means is in said lowered position thereby directing upwardly the blast from an inadvertent explosion of a pyrotechnic material being processed therein.

2. A safety enclosure which provides 360° access to equipment within comprising:

a frame means;

said frame means capable of being leveled;

said frame means having a pressure vessel head means affixed thereon;

Said pressure vessel had means having a blast shield means affixed thereto and extending vertically above a flange means;

said flange means being a horizontal mating member extending from the upper most part of said pressure vessel head means;

a access door means having a guide roller means affixed thereto for tracking of said access door means in vertical movement along said frame said directly above said pressure vessel head means;

said access door means having a flange means at it's lower most portion;

said flange means being a horizontal mating member encircling said access door means and capable of mating with said flange of said pressure vessel head means;

said flange means affixed to said access door means having a swing clamp means capable of being in a open position and a closed position affixed thereto so that when the mating members of said access door means and said pressure vessel head means are communicating with each other said swing clamp means may be placed in the closed position locking said pressure vessel head means and said access door means in the communicating position;

a cable means affixed at one end to said access door means and at the opposite end to a counter weight means suspended within said frame means and said cable means communicating with a pulley means affixed to said frame means for raising and lowering said access door means; whereby in the lowered position of said access door means processing of explosive materials may be done safely and in the raised position of said access door means the processing equipment is easily accessible for repair.

* * * * *